US006738992B2

(12) United States Patent
Lochtefeld

(10) Patent No.: US 6,738,992 B2
(45) Date of Patent: May 25, 2004

(54) METHOD AND APPARATUS FOR CONTROLLING BREAK POINTS AND REDUCING RIP CURRENTS IN WAVE POOLS

(76) Inventor: Thomas J. Lochtefeld, 210 Westbourne, La Jolla, CA (US) 92037

( * ) Notice: Subject to any disclaimer, the term of this patent is extended or adjusted under 35 U.S.C. 154(b) by 0 days.

(21) Appl. No.: 10/243,842

(22) Filed: Sep. 16, 2002

(65) Prior Publication Data

US 2003/0009821 A1 Jan. 16, 2003

Related U.S. Application Data

(63) Continuation of application No. 09/987,821, filed on Nov. 16, 2001, now Pat. No. 6,460,201.

(60) Provisional application No. 60/248,543, filed on Nov. 16, 2000.

(51) Int. Cl.[7] ..... A47K 3/10

(52) U.S. Cl. ..... 4/491

(58) Field of Search ..... 4/488, 491, 904; 405/79

(56) References Cited

U.S. PATENT DOCUMENTS

| | | | | |
|---|---|---|---|---|
| 1,536,875 A | | 5/1925 | Bowen | |
| 1,701,842 A | | 2/1929 | Fisch | |
| 1,871,215 A | | 8/1932 | Keller et al. | |
| 2,815,951 A | | 12/1957 | Baldanza | |
| 3,005,207 A | | 10/1961 | Matrai | |
| 3,473,334 A | | 10/1969 | Dexter | |
| 3,557,559 A | | 1/1971 | Barr | |
| 3,562,823 A | | 2/1971 | Koster | |
| 3,598,402 A | | 8/1971 | Frenzl | |
| 3,913,332 A | | 10/1975 | Forsman | |
| 4,276,664 A | | 7/1981 | Baker | |
| 4,515,500 A | | 5/1985 | Bastenhof | |
| 4,522,535 A | | 6/1985 | Bastenhof | |
| 4,564,190 A | | 1/1986 | Frenzl | |
| 4,805,896 A | | 2/1989 | Moody | |
| 4,905,987 A | | 3/1990 | Frenzi | |
| 4,999,860 A | * | 3/1991 | Chutter et al. | 4/491 |
| 5,058,219 A | * | 10/1991 | Teratsuji et al. | 4/488 |
| 5,171,101 A | | 12/1992 | Sauerbier et al. | |
| 5,401,117 A | | 3/1995 | Lochtefeld | |
| 5,421,782 A | | 6/1995 | Lochtefeld | |
| 5,667,445 A | | 9/1997 | Lochtefeld | |
| 5,758,369 A | | 6/1998 | Takahashi et al. | |
| 6,336,771 B1 | | 1/2002 | Hill | |

FOREIGN PATENT DOCUMENTS

| | | |
|---|---|---|
| DE | 2222 594 | 11/1973 |
| DE | 2714 223 | 10/1978 |
| FR | 1539959 | 9/1968 |
| SU | 682-238 | 8/1979 |

* cited by examiner

*Primary Examiner*—Charles E. Phillips
(74) *Attorney, Agent, or Firm*—J. John Shimazaki

(57) ABSTRACT

The invention relates to a wave pool wherein a portion of the floor and/or beach is provided with a grated section. With the grated section extending along the beach, the grates will allow water to pass into a cavity, wherein backflows are eliminated and rip currents are avoided. With the grated section extending along the floor, the grated section is able to change the effective depth of the pool floor at that location, thereby altering the wave formation characteristics. One or more channels can be provided to circulate water away from the cavity toward the other end of the pool, which helps keep the pool in substantial equilibrium.

20 Claims, 5 Drawing Sheets

Contoured Break Area

METHOD AND APPARATUS FOR CONTROLLING BREAK POINTS AND REDUCING RIP CURRENTS IN WAVE POOLS

RELATED APPLICATION

This application is a continuation of the filing dates of U.S. patent application Ser. No. 09/987,821, which was filed on Nov. 16, 2001, now U.S. Pat. No. 6,460,201 and U.S. Provisional Application Serial No. 60/248,543, which was filed on Nov. 16, 2000.

FIELD OF THE INVENTION

The present invention relates to the field of wave pools, and in particular, to a wave pool that generates large surfing class waves and has been adapted to control breakpoints and/or reduce rip currents.

BACKGROUND OF THE INVENTION

Wave pools have become popular at water theme parks in recent years. Wave pools are man-made bodies of water in which waves are created much like waves in an ocean. A wave pool typically has a wave generating machine located at one end and an artificial sloped "beach" located at the other end, wherein the wave generating machine creates periodic waves that travel from one end to the other. The floor of the pool near the beach is preferably sloped upward so that as the waves approach, the floor causes the waves to "break" onto the beach.

One problem associated with creating waves in wave pools is that rip currents, similar to those that exist in nature, can be created. For example, rip currents can be formed by the reverse flow of water (down the sloped beach) flowing against oncoming waves, which can detrimentally affect how water and energy dissipate, i.e., it can cause waves to break sooner and more dramatically, which in turn, can generate more white water and mass transport of water onto the beach. This not only makes surfing and water skimming maneuvers more difficult to perform, but it can also lead to an increased risk of injury.

In recent years, this problem has worsened due to the use of more powerful wave generating machines in wave pools designed to produce larger waves. These machines are typically installed in pools that are larger and have deeper floors than conventional wave pools. The object has been to produce larger and more frequent waves, and to enable surfing and water skimming maneuvers to be performed thereon.

Such wave pools have several disadvantages. One is the increased occurrence of rip currents, with their attendant risks, which can make it more difficult for participants to perform surfing and water skimming maneuvers safely. Second, wave pools that are larger are inherently more expensive to construct. In this respect, many wave pools are installed in areas where land is scarce, and therefore, building larger wave pools, simply to increase wave size, is not often cost-effective. This is particularly true where wave pools are already installed and significant effort and expense would be needed to modify and enlarge them. Third, where wave pools are used to host surfing exhibitions and competitions, making wave pools larger has the detrimental effect of forcing spectators (who are normally seated on bleachers or grandstands immediately behind the beach) further away from the waves, which can leave spectators further away from the action. This is particularly true given that one way to make wave pools safer is to decrease the slope of the pool floor, which in turn increases the distance between where the waves break and where the spectators are located. Fourth, in order to maximize the productive asset value of a wave pool, it is optimal to attempt to increase the frequency of wave generation in order to allow an increased number of riders per hour with a corresponding increase in revenue per hour using the same asset base. Of consequence with increased wave frequency is increased water movement with resulting increased production of rip currents. A shorter time period between each wave also means there is less time for a fallen rider to move out of the way of a new rider on a succeeding wave. Finally, competition surfing class wave-pools will often employ rapid changes in pool bottom topology in order to cause preferred plunging style breakers. Abrupt bottom contours are viewed as hazardous by governmental health and safety organizations, given the increased potential for bathers to loose their footing and inadvertent head injuries and diving accidents.

What is needed, therefore, is an improved wave pool design which enables larger and more frequent quality waves to be produced in a safe manner, without having to increase wave pool size, while at the same time, enabling the control of wave breaking characteristics and reduction of rip currents, which would otherwise be detrimental to wave formation.

SUMMARY OF THE INVENTION

The present invention represents an improvement over previous wave pool designs insofar as it enables control over the breakpoint and reformation of a wave and reduces detrimental rip currents, while allowing larger and more frequent quality waves to be created, without increasing pool size or floor design hazard. The present invention is able to accomplish this by: (1) providing one or more grates on the pool floor and along the beach side of the pool to allow water and energy from a generated wave to pass through into a cavity below, such that wave breaking characteristics can be controlled, reverse flow minimized, and rip currents reduced; and (2) providing a spatial sequencing in pool bottom topography that allows a generated swell to break, reform into an unbroken swell, and then break again.

Wave pools are typically constructed like large swimming pools, with a sloped floor on one shallow end, wherein a wave generating device is provided at the deep water end, to generate periodic waves that travel across the pool to the shallow end where the beach is located. To diminish the size of the wave as it approaches the shore, wave pools can have side walls that fan out and expand toward a beach area, as well as a sloped inclined floor which causes waves to break. The sloped inclined floor near the beach can cause water moved by the energy of a progressive wave to roll-up the inclined floor until the wave energy is spent, wherein gravity then causes the water to flow back down against other oncoming waves, thereby creating an undercurrent of water that forms rip currents.

In one aspect, the present invention represents an improvement over previous wave pool designs in that it is specifically adapted to reduce rip currents that normally occur in and around the beach area. While energy from a wave breaking along the beach normally creates white water and mass transport of water onto the beach, the after-break zone and beach area of the present invention preferably comprises a grated floor that allows water to pass through into a cavity below, away from the beach surface and thus avoiding a large surge run-up on the beach. That is, as each wave breaks and its forward momentum causes water to flow up onto the beach, water is allowed to pass through the grated floor, and into the cavity below, such that virtually none of the water is allowed to flow back onto the inclined floor of the beach and flow back down again against the oncoming waves. In such case, most of the water that would otherwise flow up the beach simply passes through the grated floor, and is effectively removed from the beach to reduce rip currents.

Reducing rip currents in this respect enables the frequency of the waves to be increased, i.e., more periodic waves can be generated in a shorter amount of time, since there are no rip currents to adversely affect each oncoming wave. In a commercial wave pool environment, a greater wave frequency advantageously results in increased rider throughput, which means greater revenue and a higher rate of return on fixed assets. Reducing rip currents also allows the waves to be made larger and more powerful without having to increase pool size, nor the risk of injury to participants. It also makes more efficient use of existing resources, such as land, since wave pools of the present invention do not have to be enlarged to increase wave size and quality. In fact, the present invention can make it so that wave pools can be made smaller and more compact without sacrificing performance and safety. Also, as mentioned above, an additional benefit of the present invention is that spectator viewing areas behind the beach can be located closer to the waves, which can enhance the viewers' experience. Finally, by introducing a grated false floor near the bottom of the pool, the true pool bottom can be made steeper, which in turn, can help create larger and more powerful waves, without changing the effective floor depth (for the participants) and without increasing the risk of drowning associated with deeper pools.

Another aspect of the present invention is that it preferably has a circulating means to allow water to circulate from one end of the pool to the other, and then back again, without interfering with wave formation. As the wave generating machine generates waves, the waves will travel across the pool and onto the beach area, but as water flows through the grated floor, and into the cavity below, water will tend to build up and spill over back onto the sloped floor, thereby defeating the purpose of the invention, unless a circulation means is provided.

The circulation means of the present invention can be an underground channel that extends under the pool floor and connects the beach end of the pool to the end where the wave generating machine is located. This way, as wave energy pushes water toward the beach, and water on that end of the pool effectively builds up, water can be diverted away from that end and back towards the wave generating machine (on the other end), thereby helping to maintain the level of water in the pool at both ends in substantial equilibrium. And, by enabling water to be recirculated back to the other end of the pool within an underground channel, the wave formations in the pool are not disturbed thereby.

The circulating means of the present invention can be operated either with a pump or without a pump. Without a pump, the channel under the pool floor can be adapted so that the restoring force of gravity alone can help maintain the level of water in the pool in equilibrium. That is, as water is pushed toward the beach and into the cavity, a high pressure area is created, i.e., the water level at that end of the pool rises. At the same time, as water is pushed away from the wave generating machine, a low pressure area is created, i.e., the water level at that end decreases. Accordingly, as water seeks its own level, the difference in pressure between the two ends of the pool can cause the level of water to reach equilibrium naturally, i.e., by causing water to flow through the underground channel in the appropriate direction.

When a pump is provided, the pump can be used to help circulate water in the appropriate direction, which is away from the beach end, and towards the wave generating end. In this embodiment, the pump preferably runs at a predetermined flow rate depending on the frequency and volume of the waves being generated by the machine. For example, when the wave generating machine is operated at high levels, the pump would operate at a relatively high level to ensure that an equilibrium can be achieved. On the other hand, when the wave generating machine is operated at low levels, the pump would also operate at a relatively low level. In this respect, the pump can be located within the underground channel, or can be incorporated within the wave generating machine. When incorporated with the wave machine, the pump can be combined with a tank reservoir to surge and generate waves.

In one embodiment, the wave generating machine is located above the underground channel (in front of the return) so that water can recirculate under and behind the wave generating machine, and then be drawn directly from the channel so that it can be used to create additional waves. In this case, an opening (return) in the channel is preferably located behind the wave generating machine, i.e., on the side opposite the beach area, so that water can circulate behind the wave generating machine, and, as the wave generating machine draws water from the channel, it can direct wave energy away from the return and toward the beach area. This ensures that the wave energy from the machine is not directed against the flow of water inside the channel. In such case, no other mechanism would be required to direct energy and water away from the channel.

In another embodiment, the wave generating machine can be located at the edge of the pool opposite the beach area, wherein water could be drawn from the underground channel through an opening in front of the machine adjacent the bottom of the pool. In this embodiment, the wave generating machine draws water from the channel through a grate in the channel. A separate mechanism is preferably provided to direct wave energy away from the channel, which enables water and energy generated by the wave generating machine to be directed away from the channel, such that energy is not directed against the channel flow.

In one aspect, the sloped floor along the beach area can be extended up above the mean standing water level of the pool. This way, as the waves break and water is pushed up onto the beach area, water will travel up and over the upper edge of the floor. Once water flows up and over the upper edge, it falls into the cavity below, and cannot flow back down into the pool against the oncoming waves (unless the water level in the cavity fills up). This helps reduce the tendency of the wave pool to create rip currents and additional rebounding effects, which can occur as water traveling through the grated floor hits the far wall under the grated floor, wherein the impact can otherwise cause water to rebound and flow back against the oncoming waves.

In another variation of the above embodiment, the far wall below the grated floor can be sloped or inclined so that as water passes through the grated floor and into the cavity, the energy from the waves can be dissipated gradually, i.e., as it climbs up the slope or incline, in which case the rebounding effects can be reduced. This aspect is particularly advantageous in embodiments where the upper edge of the floor does not extend above the mean standing water level, or where there is no pump or other mechanism to circulate water away from the beach toward the other end of the pool, wherein water could otherwise build up and fill the cavity and overflow back into the pool.

The relationship between the depth of the water over a solid pool floor and the breakpoint or reformation to an unbroken wave is adequately described by conventional wave physics encompassing wave height, speed, frequency, etc. The subject invention uniquely describes a spatial relationship between pool floors that, due to changes in topography, cause a wave swell to break, subsequently stop and reform to a smaller unbroken wave swell, and then break again.

In this embodiment, the pool floor can be adapted to have additional alternating inclined and deep water grated floor areas, wherein a subject wave can break, reform and break again, etc. This embodiment makes use of basic wave physics, i.e., the breaking characteristics of a wave is a function of pool floor depth. The first inclined floor section is adapted to cause a first break, but then terminates (where the adjacent grated deep water floor begins). Then, the open characteristics of the grated floor suspended over a deep water cavity allows the wave to "feel" that it is in deeper water, so that as the wave progresses and reaches the deeper water area, the wave stops breaking and reforms into an unbroken wave. By terminating the first inclined floor section and providing a grated floor suspended above a deep water hollow beyond it, the wave formation can transition from unbroken, to breaking, to unbroken, i.e., as the wave progresses across the pool. This is done in correspondence with a series of alternating inclined floor sections succeeded by deep water hollow sections.

It should be noted that one side effect of the grated floor is that it causes a loss of wave energy due to friction and thus a corresponding reduction in wave size as the wave progressively moves over the grated floor and towards the beach. Consequently, to maximize wave size and still take advantage of wave reformation and rebreaking, the grates could be eliminated, and a solid floor with variations in pool depth from one section to another can be provided. As a trade-off for grate elimination, however, the beneficial effects of enhanced rider footing and stratification of rip current flows below a false grated floor would be lost. Accordingly, removable grates could be used to allow dual mode functionality and is preferred.

If additional waves are desired within the pool, the pool can be adapted to have additional alternating inclined and deep water (grated) floor sections. That is, as the wave travels forward, it can, if desired, be adapted to encounter another, i.e., a second, inclined floor section within the pool, wherein another breaking wave formation can be generated, wherein again, another deep water (grated) floor can subsequently be provided, to enable the wave to stop breaking and reform. This starting, stopping and restarting of a wave's breaking characteristics, as it progressively moves from one end of the pool to the other, advantageously allows an arithmetic increase in the number of surfer take-off points and maximizes, from a surfer's perspective, the most valuable part of the wave, i.e., the transition area between breaking curl and unbroken wave.

Additionally, the ability to control a wave's formation and how it breaks within the pool maximizes the number of rides derived from any given wave and the length of such rides. That is, surfable waves can be created wherein a surfer can catch the first break point of a given wave moving toward the beach; this same wave can subsequently be re-used (caught) by a second surfer catching the reformed wave. Furthermore, if the wave breaks obliquely to the pool beach, then, each surfer gets to take advantage of the entire width of the pool for maximum ride length enjoyment.

An additional benefit to deep water hollows subsequent to an inclined floor break area is enhanced operational safety. In the event of a rider falling, the reform area deepens and the wave stops breaking. This allows a fallen surfer to quickly recover and avoid collision with an inside rider. Also, by providing alternating sections of inclined and deep water (grated) floor areas within the pool, the entire pool can be used to create a multiplicity of surfable waves, as opposed to a solitary periodic wave found in typical wave pools. Due to the initial breaking of the outside wave, the inside reform, and the subsequent inside breaking, waves are reduced in size as compared to the outside wave. However, this allows the inside wave to be the ideal break for beginners. Furthermore, the distance that a reformed swell travels before encountering a subsequent inclined slope portion of the pool floor must also be considered in maximizing the functionality and safety of the wavepool. Ideally, this distance is kept to a minimum in order to reduce pool size and associated costs of construction and operation. However, this distance must be sufficient to avoid mixing outside wave riders from inside.

These alternating inclined and deep water (grated floor) areas can be configured in virtually any manner to produce the desired results. For example, the inclined and deep water (grated) floor areas can be extended normal to the travel direction of the waves, or diagonally, in which case the waves that are formed travel at an oblique angle in relation to the beach. The inclined floor areas can also be adapted so that they extend across only a portion of the width of the pool, wherein wave formations can be generated in isolated sections of the pool. In their broadest forms, the inclined and grated floors can be separated from one another, and placed on top of each other, wherein the grated floor can be extended above the inclined floor. In such case, the grated floor is able to support the participants, while the inclined floor is adapted to create the desired wave formations. For example, the inclined floor can be made to have different inclinations and depressions to form unique wave formations, while at the same time, the grated floor can be extended horizontally (separate from and above the inclined floor) to provide a relatively level and safe support for the participants.

DETAILED DESCRIPTION OF THE INVENTION

Figure 1:
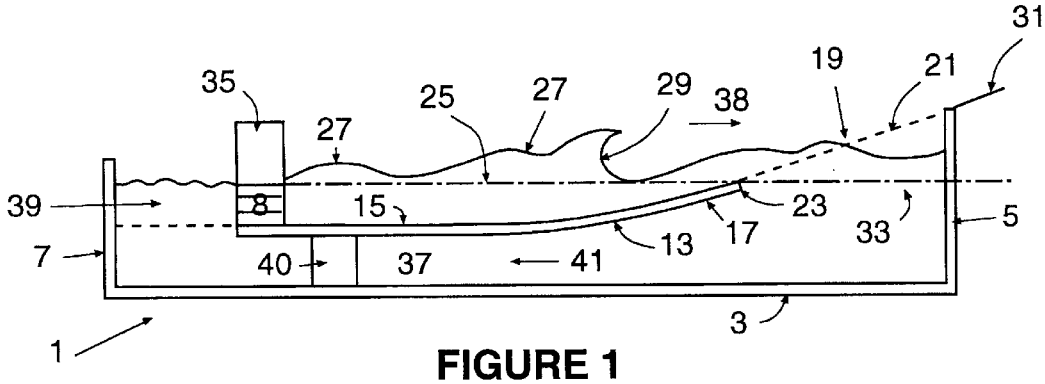
FIG. 1 is a cross-section view of an embodiment of the present invention showing the grated floor extending upward from the upper edge of the pool floor, located substantially at the mean water level, and a pump in the channel substantially under the wave generator.
Figure 2:
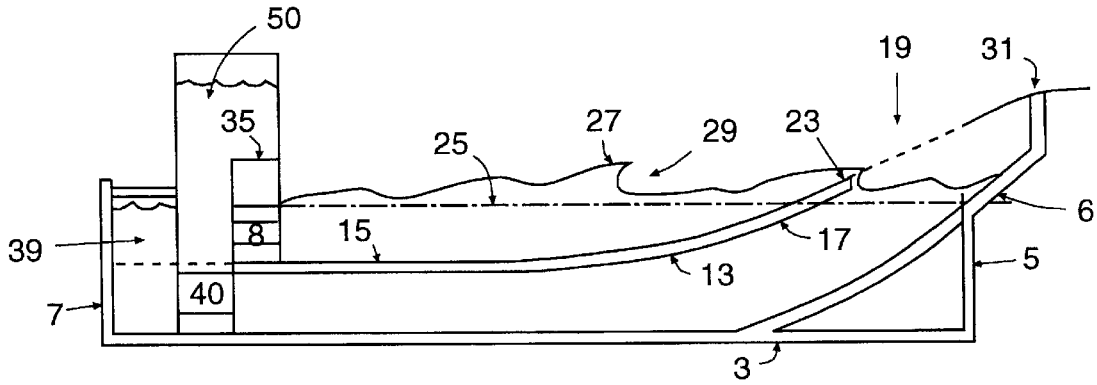
FIG. 2 is a cross-section view of an embodiment of the present invention showing the grated floor extending upward from the upper edge of the pool floor, located slightly above the mean water level, and an inclined floor under the grated floor.
Figure 3:
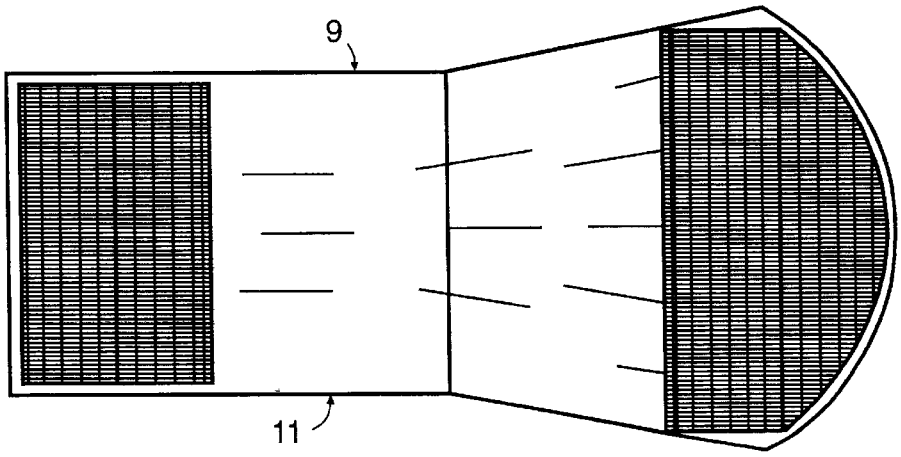
FIG. 3 is a top view of the present invention of FIG. 4 showing the grated floor on the beach area and the return grate on the pool floor on the opposite end.

FIGS. 1 and 2 show two embodiments of the present invention relating to a method and apparatus for reducing rip currents in a wave pool 1. Wave pool 1 can be constructed much like a large swimming pool with a bottom floor 3 and end walls 5 and 7, along with side walls 9 and 11, shown in FIG. 3, preferably made of concrete or other conventional material set into the ground. Wave pool 1 preferably has an additional raised floor 13 above the bottom floor 3. Raised floor 13 preferably has a relatively level portion 15 on one end and a relatively sloped portion 17 on the other end, extending upward toward a sloped beach area 19. The raised floor 13 can be made of concrete or similar material and can be supported above the lower floor 3 by supporting walls running end to end, or other conventional manner.

A wave generating device 35 is preferably provided at one end of the pool 1, adjacent or near the level end 15 of the raised floor 13. The device 35 can preferably be used to create periodic waves 27 that travel across the wave pool 1 in a direction (shown by arrow 38) toward the beach area 19. The wave generating device 35 can be any conventional generator, such as those that are hydraulically, mechanically or pneumatically operated. Preferably, the device 35 has sufficient power to create large, surfable quality waves as is known in the art.

The level portion 15 and sloped portion 17 are preferably adapted to enable the wave pool 1 to produce large, surfable quality waves. The wave pool 1 is adapted such that as periodic waves 27 travel across the pool 1, they break toward the beach 19, wherein the sloped surface 17 causes the waves to break. The sloped portion 17 is preferably sloped to optimize the size and quality of the waves. For surfing, these slope characteristics are well known in the art as described in the publications entitled "A Stationary Oblique Breaking Wave for Laboratory Testing of Surfboards," by Hornung/Killen, and "Model Studies for a Wave Riding Facility," by Killen, which are incorporated herein by reference.

In these embodiments of FIGS. 1 and 2, the wave pool 1 of the present invention preferably has a grated floor 21 extending above the mean standing water level of the pool along the beach area 19. The grated floor 21 is preferably extended above the upper edge 23 of the raised floor 13, and has substantially the same or extended slope as the sloped portion 17, as shown in FIGS. 1 and 2, and forms a part of the beach floor. The grated floor 21 is preferably extended upward along the majority of the beach area 19 such that wave water can pass through the grated floor 21 down into a cavity 33 below.

Above the grated floor 21, the beach area 31 can be extended above and beyond the end wall 5. In this respect, a larger playing surface 31 can be extended from and provided above the grated floor 21, which can be provided with seating areas, such as bleachers or grandstands, to provide viewing for spectators when desired. The grates 21 are preferably adapted to allow water to pass, while being suitable in size and shape to enable people to walk safely thereon in their bare feet. In this respect, the grates themselves are preferably provided with a smooth surface and can be made of any conventional material such as fiberglass.

The grated floor 21 preferably allows water from waves 27 and 29 to pass through into the cavity 33 below, thereby reducing the propensity of the wave pool 1 to form rip currents. In a normal wave pool, the waves that break onto the beach area 19 cause water to flow up, and then back down again in a reverse direction, causing it to flow against the oncoming waves. This can create undesirable undercurrents in the path of the oncoming waves, which can result in the creation of rip currents. Depending on the size of the waves, and the amount of water flowing in a reverse direction, these rip currents can adversely affect how the waves and their energies dissipate, which can be detrimental to the proper formation and breaking of the waves.

These conditions are virtually eliminated by the present invention because the energy and water from the waves 27 and 29 are allowed to pass through the grated floor 21 and dissipate under the grated floor in the cavity 33 below, away from the participants and oncoming waves. The water that would normally flow up onto the beach 19 and be allowed to flow in a reverse direction to create "rip currents" simply passes through the grated floor 21 and into the cavity 33 so that little or no adverse effects are created thereby.

One of the additional advantages provided by the present invention is that by being able to dissipate the water and energy from the waves in the manner described above, the beach area 19 can be made more compact, i.e., the slope of the beach does not have to be extended to gradually dissipate wave energy. And, with more compact designs, the present invention provides the additional advantage of allowing the wave pool 1 to be constructed at lower costs. Also, more compact designs enable spectator areas to be closer to the breaking waves, i.e., closer to the action, such that spectators can see the participants better. Moreover, the subject invention's ability to dissipate wave energy on the beach allows an increase in wave frequency with no resulting adverse rip current consequence. Increased wave frequency enables a greater number of riders to use the base pool assets, which, in turn, generates additional operator revenue.

The present invention also preferably has circulating means to cause water to circulate from one end of the pool to the other end, and then back again, without interfering with wave formation. As water flows through the grated floor 21 and into the cavity 33 below, water will tend to build up and fill the cavity 33 and spill back over onto the sloped floor 17, which can defeat the purpose of the invention, unless the water in the cavity is circulated out. The present invention preferably accounts for this occurrence by providing means for circulating water in the cavity 33 back to the other end of the pool, wherein the water can then be drawn to create additional waves.

The preferred circulating system of the present invention comprises one or more underground channels 37 that connects the beach end of the pool 1 to the other end. The channels 37 are preferably formed under the raised floor 13 and between the lower floor 3 and raised floor 13. The channels 37 preferably allow water to flow from the beach end of the pool 1 towards the wave generating device 35 so that the body of water in the pool can remain in substantial equilibrium. That is, as energy from the waves pushes water toward the beach area 19, water on that end of the pool will tend to rise as it fills the cavity 33. By circulating water away from the cavity end of the pool 1, and towards the other end, the water level on both ends of the pool can be maintained in substantial equilibrium. Likewise, ripcurrents are avoided since return water moves underneath the propagating surface wave train.

In this respect, the preferred embodiment of the present invention preferably has an underground channel 37 (or multiple channels) in the space between the raised floor 13 and lower floor 3. The underground channel 37 enables water to be circulated from the cavity 33 (at the beach end of the pool) in a reverse direction (shown by arrow 41) to the other end of the pool where the return area 39 is located. Multiple channels running in the appropriate direction can be formed when desired, such as between support walls extending between the bottom floor 3 and raised floor 13.

The channels 37 are preferably sized to enable the flow of water (rate and volume) to be sufficient to allow equilibrium to be substantially achieved between the water level in the cavity 33 and water level in the return area 39. That is, channels 37 preferably enable water to flow through the channel at a rate that is substantially equal to or greater than the amount of water pushed into cavity 33 by the action of the waves. In this respect, the size of the channels 37 under the raised floor 13 is preferably such that the restoring force of gravity alone can maintain the level of water in substantial equilibrium. As water is pushed toward the beach area 19 and into the cavity 33, a high pressure area is created as the water level at that end rises. At the same time, as water is pushed away from the wave generating device 35, a low pressure area is created at that end of the pool as the water level drops. As water seeks its own level, the difference in pressure between the two areas naturally causes the water to flow through the channels 37 in a direction 41 toward the return 39, i.e., to reach equilibrium.

The embodiment of FIG. 1 shows the floor 3 and area under the raised floor 13 to be configured like the bottom of a swimming pool. The slope of the raised floor 13, however, causes the channel to be narrower under the level portion 15. Accordingly, the size of the opening under the level portion 15 typically controls the flow of water through the channel 37 and therefore is considered in determining the overall size of the channel 37 to provide the appropriate flow.

The present invention can also have a pump 40, as shown in FIGS. 1 and 2, to help circulate the water in the channel 37 if desired. The pump 40 preferably pumps water through the channel 37 in a predetermined direction 41 and at a predetermined rate. Preferably, the pump 40 helps circulate water in the appropriate direction, which is away from the cavity 33, and towards the wave generating device 35. The pump 40 can preferably be set to run at a predetermined flow rate depending on the frequency and volume of the waves being generated by the wave generating device 35. That is, when the wave generating device 35 is operated at high levels, the pump 40 can likewise be operated at comparably high levels to ensure that an equilibrium can be reached between opposite ends of the pool. On the other hand, when the wave generating device 35 is operated at low levels, the pump 40 would also be operated at comparably low levels to achieve an equilibrium in the pool. The pump 40 can be located within the channel 37, as shown in FIG. 1, or can be part of the wave generating device 35, wherein the pump can be directed to fill a reservoir 50 used to make waves via conventional hydraulic methods, as shown in FIG. 2.

The return 39 at the opposite end of the pool is, as shown in the embodiments of FIGS. 1 and 2, preferably positioned behind or substantially under the wave generating device 35, on the end opposite the beach area 19. In the embodiment of FIG. 1, the wave generating device 35 is located above the channel 37 and in front of the return 39 such that water in the channel 37 can circulate under and behind the wave generating device 35. Water can then be drawn directly through the return 39 which is needed by the wave generating device 35 to create additional waves. By locating the return 39 behind, underneath or to the side of, the wave generating device 35, water can be circulated to the wave generating device 35, and then directed forward in a direction 38 toward the beach area 19 (away from the return 39), which can ensure that none of the wave energy is directed against the flow inside the channel 37. In such case, no other mechanism is required to direct energy and water (which flows in a direction opposite the flow in the channel 37) away from the channel 37.

Figure 4:
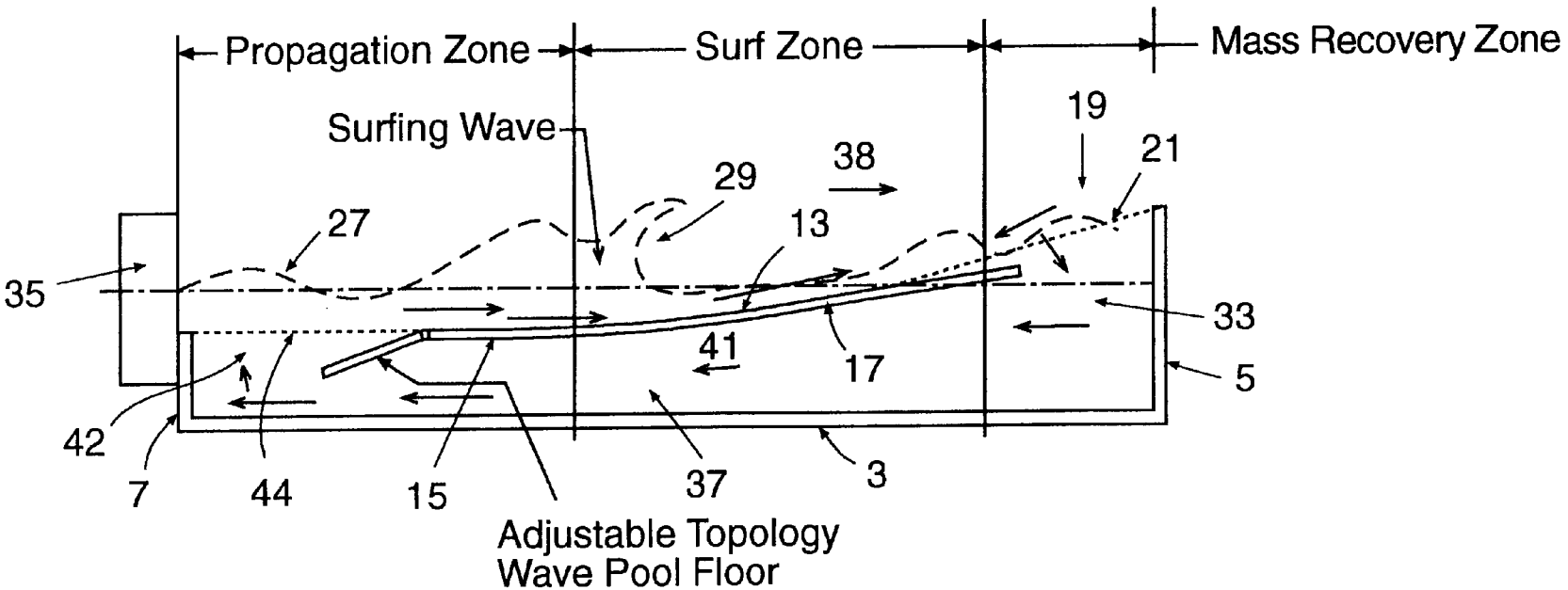
FIG. 4 is a cross-section view of an embodiment of the present invention showing the grated floor extending above the upper part of the pool floor and the wave generator located at the far end of the pool with an adjustable topology floor.

In the embodiment shown in FIG. 4, the wave generating device 35 is located on the edge of the pool 1 opposite the beach area 19, wherein water can be drawn from the channel 37 through an opening 42 adjacent the device 35 located on the raised floor 13. In this embodiment, the wave generating device 35 can draw water from the channel 37 through grate 44 provided on the level portion 15 of the raised floor 13. A separate mechanism, such as an adjustable topology floor or door 46, which pivots between open and closed positions, can be provided to direct energy from the waves (created by the device 35) toward the beach area 19 and away from the channel 37. The opening and closing of the door 46 is preferably timed and sequenced with the generation of the waves so that the door 46 helps direct water and energy away from the channel 37 (with every wave that is formed). This can help ensure that water movement and energy generated by the device 35 will not be directed against the flow of water in the channel 37, i.e., it will not slow down or inhibit the circulation of water through the channel 37.

In the embodiment shown in FIG. 1, the upper edge 23 of the raised floor 13 can be terminated, and the grated floor 21 can begin, at about the mean standing water level 25 of the pool. This enables water and energy to be easily passed through the grated floor 21 and into the cavity 33, particularly when pump 40 is used to lower the level of water in the cavity 33. In a variation of the present invention, which is shown in FIG. 2, the sloped portion 17 of the raised floor 13 can be extended up the beach area 19, wherein the upper edge 23 extends slightly above the mean standing water level 25 of the pool. In this way, as waves break and water is pushed toward the beach area 19, water must travel up the sloped portion 17 and over the upper edge 23 to pass through the grated floor 21 and into the cavity 33. Once water flows over the upper edge 23, water falls into the cavity 33, and is prevented from flowing back onto the raised floor 13 by the extended upper edge 23. This not only reduces rip currents, but it can also help reduce the tendency of the back wall 5 to create undesirable rebounding effects. That is, as water travels through the grated floor 21 and hits the far wall 5 of the pool (under the grated floor 21), the impact against the wall can cause water to rebound and flow back in a reverse direction. Without the benefit of the extended upper edge 23 of the floor 13, water can rebound from the wall 5, and flow back against the oncoming waves to create additional undercurrents. By extending the upper edge 23 higher, the rebounding waves will simply encounter the underside of the upper edge 23 of the raised floor 13, and then dissipate inside the cavity 33, thereby keeping additional undesirable currents from forming in the wave breaking areas (i.e., the surf zone shown in FIG. 4). In this way, the turbulence and white water caused by the waves is substantially maintained within the cavity 33 (the mass recovery zone shown in FIG. 4) and away from participants.

The present invention can also be adapted to have an inclined sloped floor on the back wall 6, as shown in FIG. 2, which can help diffuse the rebounding effects that would otherwise occur. That is, the far wall 5 below the grated floor 21 can be sloped or inclined 6 so that as water passes through the grated floor 21 and into the cavity 33, the energy from the waves will be dissipated gradually, i.e., as it climbs up the inclined surface 6. This way, the impact of the waves against the back wall 5 is diffused, which in turn, can reduce the amount and severity of the rebounding effects. This aspect is particularly advantageous in embodiments where the upper edge 23 of the raised floor 13 does not extend above the mean standing water level, or where there is no pump 40 or other mechanism to circulate water away from the cavity 33.

Using the above embodiments of the present invention, the white water and mass transport of water toward the beach that could otherwise create a dangerous condition is virtually eliminated because the energy and water of the waves are allowed to pass through the grated floor 21 and dissipate in the cavity 33 under the beach 19. In this respect, the water that would normally be pushed up onto the beach 19 to create a reverse "rip current" that could affect subsequent oncoming waves, is allowed to pass through the grated floor 21 and away from the waves.

Figure 5A:
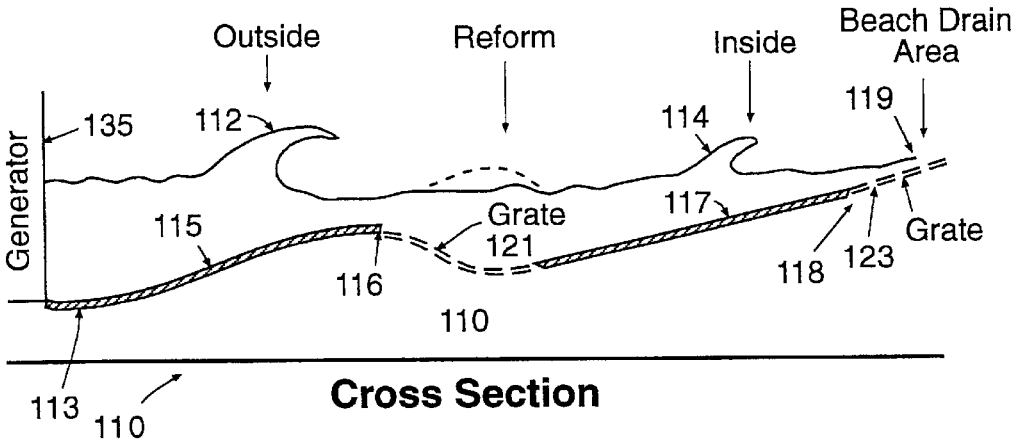
FIG. 5*a* is a cross section of an embodiment of the present invention where alternating inclined and grated declining floor sections are provided.
Figure 5B:
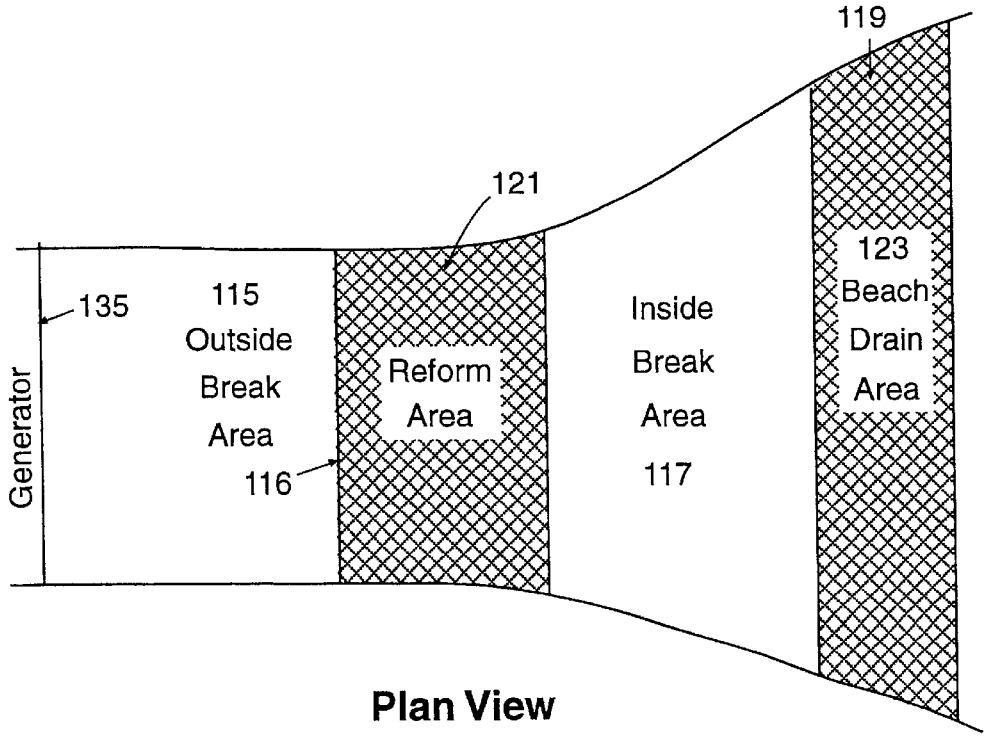
FIG. 5*b* is a plan view of an embodiment of the present invention where alternating inclined and grated declining floor sections are provided.
Figure 6A:
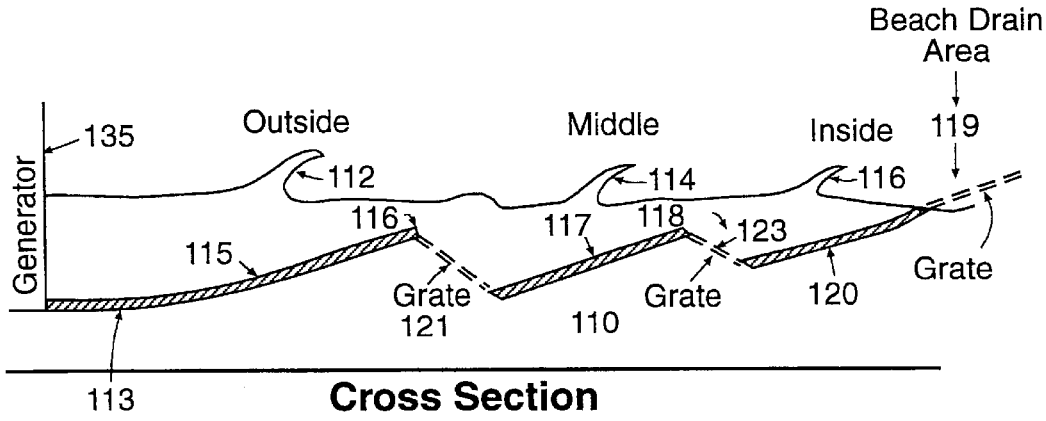
FIG. 6*a* is a cross section of an embodiment of the present invention where alternating inclined and deep water (grated) floor sections are extended diagonally in relation to the beach.
Figure 6B:
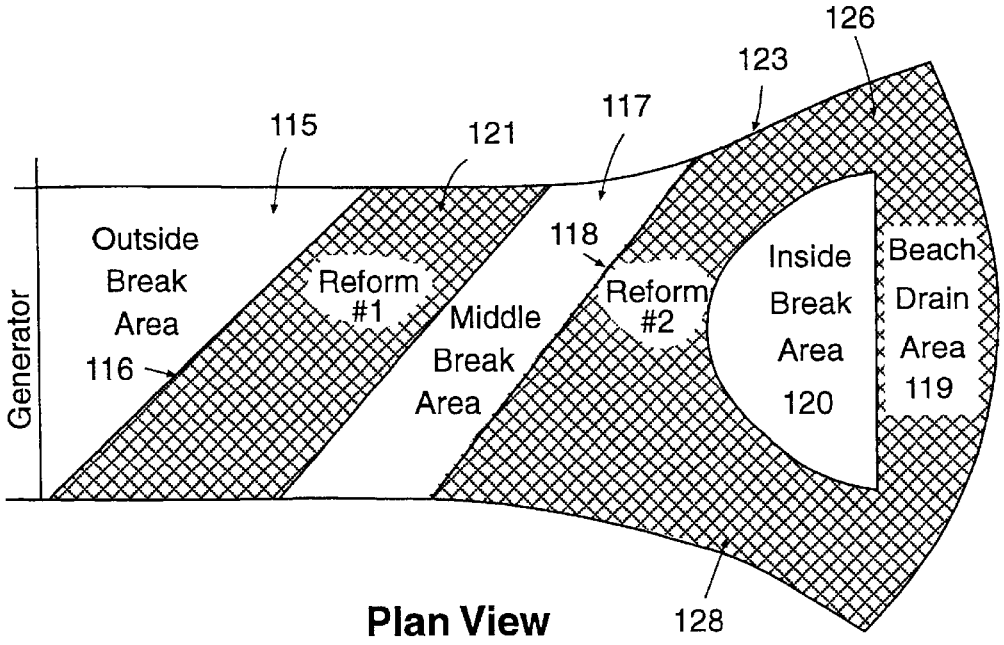
FIG. 6*b* is a plan view of an embodiment of the present invention where alternating inclined and deep water (grated) floor sections are extended diagonally in relation to the beach.
Figure 7:
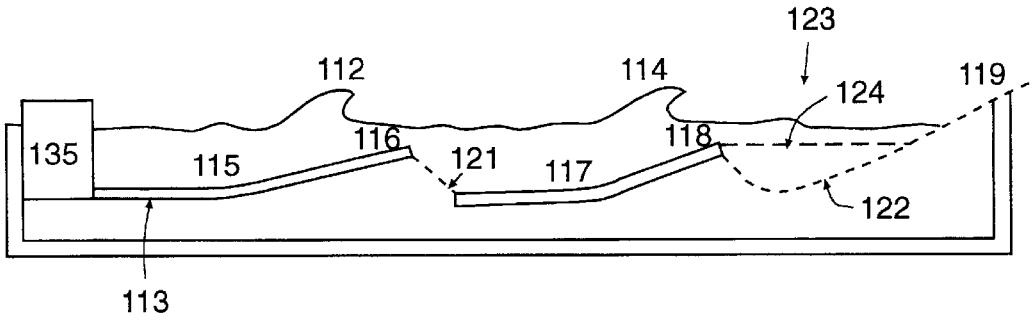
FIG. 7 is a cross section of an embodiment where alternating inclined and deep water (grated) floor sections are provided, along with a grated floor outlet area.

In the embodiments shown in FIGS. 5–7, the raised floor 113 can be adapted to have alternating inclined floor areas 115, 117 and 120 (shown in FIGS. 5*a*, 5*b*, 6*a* and 6*b*), and grated declining floor areas 121 and 123, wherein wave formations can be created and recreated that successively break, reform and break again. The first inclined floor area 115 is preferably located out in front of the wave generating device 135, and can be sloped upwardly therefrom, as shown in FIG. 5*a*, such that as waves 112 are generated, they will begin to curl forward. The inclined floor area 115 can then terminate along a top edge 116, which is preferably below the mean water level of the pool (where the adjacent grated floor area 121 begins), such that curling waves 112 will break within the pool in the desired manner. The deep water grated floor area 121 is preferably sloped downward from top edge 116 and allows water and energy from the waves to dissipate into an underground channel 110, similar to the way water flows into cavity 33 in the previous embodiments. By terminating the first inclined floor area 115 in the manner shown, and providing a deep water declining grated floor area 121 beyond it, the wave encounters an instantaneous increase in depth, which in turn, causes the wave to cease breaking.

If an additional curling wave 114 is desired within the pool 100 following the first one, the pool can be adapted to have one or more additional inclined floor sections 117, as shown in FIGS. 5*a*, 5*b*, 6*a* and 6*b*, and more deeper grated floor sections 123. As the wave travels forward through the pool, it can encounter the second inclined floor section 117, wherein another breaking wave formation 114 can be generated thereby. Thereafter, the wave formation can continue to travel until the floor section 117 terminates along the top edge 118, and gives way to the deeper grated floor area 123, to allow the wave to again dissipate in the manner discussed above. This can be repeated.

In the embodiment of FIGS. 5*a* and 5*b*, the grated floor area 123 preferably extends upward toward the beach 19 along the same or similar slope as the inclined floor section 117. On the other hand, the grated floor area 123 can be extended further up the beach 19, such as shown in FIG. 7, wherein the grated floor 123 can extend in one of several directions. First, it can extend downward from the upper edge 118 of the floor 117, as shown by dashed line 122, or secondly, it can extend level with the upper edge 118, as shown by dashed line 124. Forming the grated floor area 123 in this manner causes the wave formations 114 to transition forward without fully breaking, but also gives participants more room to exit, i.e., from a spill, without the risk of striking the grated floor along the beach 119. The beach area 119 is preferably formed by a grated floor, which can be extended relatively upward from the exit areas 122 or 124.

The embodiment shown in FIGS. 6*a* and 6*b* is similar to the embodiment of FIGS. 5*a* and 5*b*, except that the alternating inclined floor sections 115 and 117, and grated floor areas 121 and 123, are extended diagonally in relation to the beach area 119. There is also an additional inclined floor area 120 adjacent the beach area 119, shown in FIG. 6*b*, which does not extend across the entire width of the pool. In this embodiment, the first inclined floor section 115 extends upward along a diagonal slope, i.e., in relation to the wave generator 135, up to the first top edge 116. The first grated floor area 121 then extends downward from the first top edge 116, also along a diagonal slope. The second inclined floor area 117 and grated floor area 123 are also extended upward and downward, respectively, along diagonal slopes. The grated floor area 123 extends downward from the second top edge 118 (of the second inclined floor area 117), and then upwardly therefrom and around the sides of the additional inclined floor area 120. The sides 126 and 128 of the grated floor area 123 that extend around the inclined floor area 120 preferably extend along substantially the same or similar slope as the beach area 119.

The diagonal orientation of the alternating sections causes the waves 112, 114 and 116 to break obliquely in relation to the beach area 119. For example, wave 112 forms initially along one side of the pool and gradually progresses to the other side as the wave travels forward. Likewise, the wave 112 will dissipate and transition diagonally into an unbroken swell in a similar manner along the first grated floor area 121. When this swell encounters the second inclined floor area 117, the breaking wave formation 114 begins to form in a similar manner, i.e., on one side, gradually progressing to the other side in a diagonal/oblique manner as the wave moves forward. Once the wave 114 encounters the second grated floor area 123, the wave will dissipate to form a swell, wherein the swell will then begin breaking from the middle and progress obliquely to shore in both directions, as if split in half by the additional inclined floor area 120. The water that encounters the additional inclined floor area 120 will break onto the beach area 119, along the middle section thereof, whereas the swells traveling around the sides will flow through the grated floor sections 126 and 128.

Figure 8:
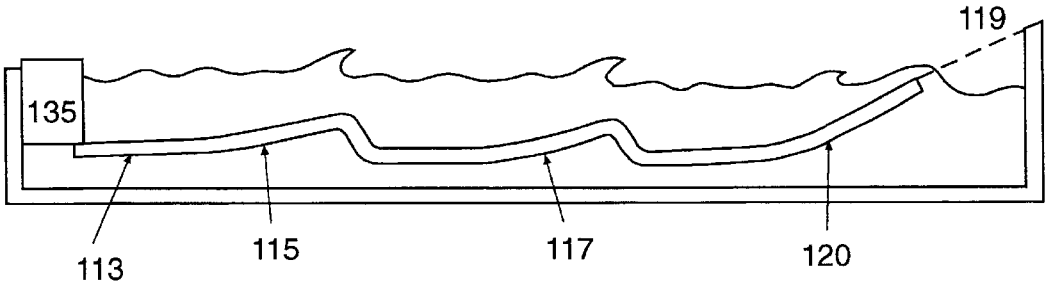
FIG. 8 is a cross section of an embodiment where the raised floor has a predetermined topography.

The embodiment of FIG. 8 represents another version of the present invention, wherein there are no grated floor sections between the inclined floor sections of the raised floor 113. In this embodiment, the raised floor 113 can be configured in virtually any manner to create the desired wave formations in the pool 100, i.e., the raised floor 113 can be configured with steep inclinations and deep depressions in order to permit progressive wave breaking and swell reformation. As shown in FIG. 8, the raised floor 113 can be adapted to have multiple wave forming sections 115, 117 and 120. In this respect, removing the grated floor sections between the wave forming sections 115, 117 and 120 enables the raised floor 113 to be independently configured, such that the waves can be formed and controlled without regard to the grates, and the raised floor 113 can be made to have different inclinations and depressions to form unique wave formations.

Figure 9:
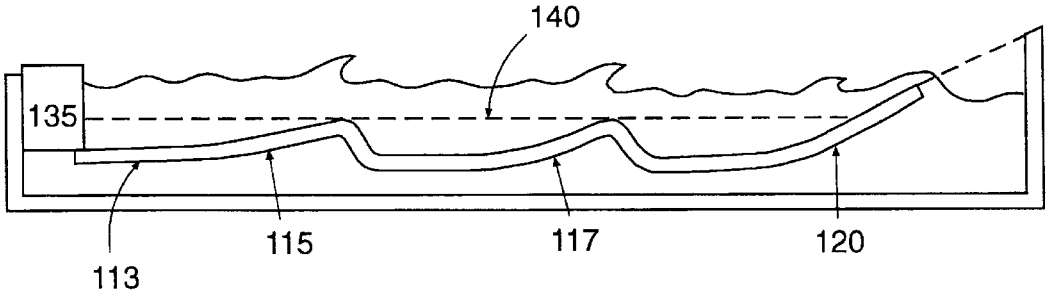
FIG. 9 is a cross section of an embodiment where the grated floor extends above the inclined floor.

FIG. 9 shows a similar embodiment, but where there is a grated floor 140 elevated above the raised floor 113. In this embodiment, the grated floor 140 can be horizontal or close to horizontal, as shown, to provide a safe and secure footing for the participants. At the same time, the wave formations can be determined by the configuration of the raised floor, without affecting the safety of the participants. In this embodiment, it is preferable that the grates themselves be made so that water movement is less affected by the grate, i.e., by making the grates further apart or otherwise less dense.

The ability to control the wave formations and how they break within the pool allows curling waves to be safely produced without creating the dangers and disadvantages of full breaking waves. That is, curling waves can be created in relatively deep water, and then again, they can be reconformed so that they do not fully break. This way, the frequency of wave generation can be safely increased. Also, by providing alternating sections of inclined and deeper (grated) floor areas within the pool, multiple sections within the pool can be used to create ridable waves, not just one wave that breaks along the length of the pool.

The wave pool of the present invention contemplates that multiple alternating inclined floor and deep water (grated) floor areas, as shown in FIGS. 5–8, can be provided so that additional surf zones can be created within the pool. The limit to the number of alternating sections that can be provided is a function of usable wave size and space constraints often encountered in installing wave pools. The alternating inclined and deeper (grated) floor areas can be configured in virtually any manner to produce the desired results.

The preferred embodiments of the present invention are discussed and shown herein. Nevertheless, variations of the present invention, which are not specifically described, are within the contemplation of the present invention.

What is claimed is:

1. A method of producing various wave effects in a wave pool, comprising:

providing a wave pool having a body of water therein with a wave generating device located at a first end or portion thereof;

providing a floor in said wave pool having at least one inclined section followed by at least one declined section located substantially remotely from said wave generating device;

providing a beach area extending above said floor;

providing a cavity beneath said floor for circulating water from above said floor to said wave generating device;

using said wave generating device to create said wave effects in said body of water; and using said at least one inclined section followed by said at least one declined section to substantially alter the wave effects within said body of water.

2. The method of claim 1, wherein the method comprises providing a grated section on said at least one declined section, wherein said grated section helps to change the effective depth of said body of water at that location, such that the wave effects produced in said body of water can be altered thereby.

3. The method of claim 2, wherein water passing through said grated section can enter into said cavity.

4. The method of claim 2, wherein said at least one inclined section and said at least one declined section extend parallel to each other, and either parallel, or diagonally, with respect to the direction of said beach area.

5. The method of claim 3, wherein said beach area is provided with an inclined grated section for allowing water to pass through, and said cavity is extended under said inclined grated section such that water passing through said inclined grated section can enter into said cavity.

6. The method of claim 5, wherein said cavity forms at least one channel to circulate water toward said wave generating device, and wherein a pump is used to circulate water through said channel, and water is drawn from said channel and used by said wave generating device to create additional wave effects in said wave pool.

7. The method of claim 5, wherein the method comprises the step of extending said inclined grated section down onto a part of said floor and extending a secondary grated section over a portion of said inclined grated section to provide footing for users in that portion of said wave pool.

8. The method of claim 5, wherein the method comprises the step of extending said floor above the standing mean water level of said wave pool, such that as waves are created by said wave generating device, water flows over an upper edge of said floor and onto said inclined grated section.

9. The method of claim 1, wherein said beach area is provided with an inclined grated section for allowing water to pass through, and said cavity is extended under said inclined grated section into which water passing through said inclined grated section can enter.

10. The method of claim 1, wherein a grated surface is extended substantially over said floor, to provide footing for users in said wave pool, without substantially affecting the wave effects in said wave pool.

11. A wave pool comprising:

a container for holding a body of water, said container having a floor with at least one inclined section, followed by at least one declined section, followed by a second inclined section, extending in a direction from a first end to a second end of said container;

a wave generating device for creating waves in said body of water located at or near said first end, and an inclined beach extending above said second inclined section of said floor located at or near said second end; and wherein at least a portion of said floor and/or beach comprises a grated section through which water and wave energy can pass, wherein said grated section is sufficient in size to alter the wave characteristics of said body of water in said container.

12. The wave pool of claim 11, wherein at least one grated section is located on said beach, and a cavity is provided under said at least one grated section into which water can enter.

13. The wave pool of claim 12, wherein at least one channel is operatively connected to said cavity and extends substantially between said first and second ends of said container, said channel enabling water passing through said at least one grated section and into said cavity to be circulated substantially from said second end to said first end, wherein said circulation helps to maintain the revel of water in said body of water in substantial equilibrium.

14. The wave pool of claim 13, wherein a pump is provided to circulate water in said channel from said second end to said first end.

15. The wave pool of claim 12, wherein said at least one grated section begins above the standing mean water level of said body of water, wherein water that flows through said at least one grated section is able to flow into said cavity, and be substantially prevented from flowing in a reverse direction back onto said floor.

16. The wave pool of claim 12, wherein at least one second grated section is located on said at least one declined section, and said cavity is extended below said at least one second grated section such that water from above said floor can enter into said cavity through said at least one second grated section, and wherein said at least one second grated section helps to change the effective depth of the body of water at that location to alter the wave effects created therein.

17. The wave pool of claim 16, wherein said at least one inclined section and said at least one declined section extend parallel to each other, and either parallel, or diagonally, with respect to the direction of said beach area.

18. A wave pool comprising:

a container with a wave generating device for creating wave effects in said wave pool;

a floor having at least one inclined section followed by at least one declined section located substantially remotely from said wave generating device for substantially altering said wave effects within said wave pool;

a beach area extending above said floor; and a cavity beneath said floor for circulating water from above said floor to said wave generating device.

19. The wave pool of claim 18, further comprising a grated section on said at least one declined section, wherein said grated section helps to change the effective depth of said body of water at that location, such that the wave effects produced in said body of water can be altered thereby, wherein water passing through said grated section can enter into said cavity.

20. The wave pool of claim 19, wherein said cavity forms at least one channel to circulate water toward said wave generating device, and wherein a pump is used to circulate water through said channel, and water is drawn from said channel and used by said wave generating device to create additional wave effects in said wave pool.

* * * * *